United States Patent [19]

McLean et al.

[11] Patent Number: 4,991,333

[45] Date of Patent: Feb. 12, 1991

[54] FURNITURE DESIGNING DISPLAY AND CARRYING CASE

[75] Inventors: Roderick G. McLean, Cazenovia; Sandy W. Soroush, Brooklyn, both of N.Y.

[73] Assignee: Harden Furniture, Inc., McConelsville, N.Y.

[21] Appl. No.: 352,286

[22] Filed: May 15, 1989

[51] Int. Cl.[5] ..... G09F 19/00

[52] U.S. Cl. ..... 40/534; 248/459; 434/429

[58] Field of Search ..... 40/594, 534, 572, 152.1, 40/156; 434/94, 365, 80, 429, 369; 248/459, 461, 444.1

[56] References Cited

U.S. PATENT DOCUMENTS

| | | | |
|---|---|---|---|
| 664,828 | 1/1901 | Bayner | 40/534 |
| 799,609 | 9/1905 | Ludwig . | |
| 1,453,833 | 5/1923 | Fleming et al. . | |
| 1,626,150 | 4/1927 | Parda | 40/156 |
| 2,294,465 | 9/1942 | Lasker . | |
| 2,309,390 | 1/1943 | Grossguth et al. . | |
| 2,756,515 | 7/1956 | Hoffman | 434/429 X |
| 2,919,502 | 1/1960 | Henry . | |
| 3,269,043 | 8/1966 | Swanson | 40/152.1 X |
| 3,325,917 | 6/1967 | Kinnaman . | |
| 3,339,453 | 9/1967 | Udich . | |
| 3,773,154 | 11/1973 | Mitchell | 248/461 X |
| 4,055,011 | 10/1977 | Longenecker | 40/124.1 |
| 4,137,650 | 2/1979 | Hayes | 40/534 X |
| 4,213,520 | 7/1980 | Sarna et al. | 248/444.1 |
| 4,371,345 | 2/1983 | Palmer et al. . | |
| 4,836,783 | 6/1989 | Harper | 434/429 X |

FOREIGN PATENT DOCUMENTS

| | | | |
|---|---|---|---|
| 11457 | 5/1904 | United Kingdom | 40/152.1 |
| 1590314 | 5/1981 | United Kingdom | 40/534 |

*Primary Examiner*—James R. Brittain

*Attorney, Agent, or Firm*—Wall and Roehrig

[57] ABSTRACT

A combination carrying/storage and display device for storing and displaying a number of furniture part transparencies in overlapping relation to form a pictorial presentation of a custom design. Five sets of parts such as arms, backs, seats, cushions and skirts are provided, each set having three to seven different styles of parts. Each individual transparency carries indicia which when combined in overlapping form displays the proper style number, dimensions, quantities of materials etc. for the furniture as designed.

9 Claims, 2 Drawing Sheets

FURNITURE DESIGNING DISPLAY AND CARRYING CASE

BACKGROUND OF THE INVENTION

This invention relates to a device for displaying an assemblage of design elements for a piece of furniture chosen from a number of transparencies each displaying an optional element to produce when superimposed a coherent overall design.

In the prior art, various display devices have been shown for creating a visual display for presentation of various design features of a product or service so that a customer may get a visual impression of the finished product or service created when the various features selected are assembled. Typical of the prior art of this type is U.S. Pat. No. 2,919,502 to Henry in which a display easel is shown for displaying a plurality of human face features for educational or sales purposes in selecting types of cosmetic treatments for a particular model's appearance. As shown in the drawings and specification a variety of facial features are provided on transparencies which can be displayed in overlapped relationship to provide a composite cosmetic image of an individual for critical review. The individual transparencies are held on a display easel by magnets in the proper position so that as they overlap they register and form a coherent total image.

According to the present invention, applicant has substantially improved the prior art display systems and has provided a combination display easel and carrying/storage case for a plurality of transparency representations of different furniture elements that can be selectively combined to design a particular piece of furniture. Applicant, in addition to the furniture design element, has provided on each transparency a code and other identification indicia that permit, when assembled in a complete presentation, the display of the complete part number or style number of the piece of furniture as designed. Preferably these indicia include the dimensions of the article, the quantities of fabric required and description of the various materials needed so that the complete specification of the piece of furniture is available at a glance, automatically without having to look up in a catalog the particular details of the piece of furniture designed.

Also the assembled transparencies of a particular furniture design may be placed in a copier for making a permanent "hard copy" record of the particular combination of transparencies selected by the customer.

OBJECTS AND SUMMARY OF THE INVENTION

It is an object of the present invention to provide a combination furniture designing display case and carrying case for custom designing furniture pieces from a plurality of individual standard elements.

It is another object of the present invention to provide a series of transparency overlays, each transparency having a particular element of a piece of furniture positioned so that when overlaid a composite aligned image is presented of the finished piece of furniture.

It is another object of the present invention to provide a series of groups of transparencies of elements of a piece of furniture, each group having a plurality of individual, different design elements so that a customer may pick a particular design element from each of the groups and then superimpose them in aligned fashion to create a pictorial representation of a finished piece of furniture assembled with those elements.

It is a further object of the present invention to provide a series of groups of transparencies for aligned superimposed display, each individual transparency within each group having thereon a code number, dimensions, yardage requirements for covering fabric, a description and special notes for each individual design element displayed.

It is a still further object of the present invention to provide a display easel for displaying a series of superimposed transparencies showing various elements of a piece of furniture in a convenient orderly fashion so as to maintain proper alignment and also to protect the transparencies during use together with a carrying case for conveniently carrying the furniture designing display kit for sales presentations to a customer.

It is a still a further object of the present invention to provide a combination carrying, storage and display device that can be easily and securely positioned on a desk top or table for displaying and storing a plurality of transparencies, each having a furniture element thereon so that when placed in said easel in overlapping relation a visual image of a complete piece of furniture is presented.

These and other and further objects of the present invention, together with additional features and advantages, will be apparent from the following description of a preferred embodiment of the invention which is shown in the accompanying drawings.

DESCRIPTION OF THE PREFERRED EMBODIMENT

Figure 1:
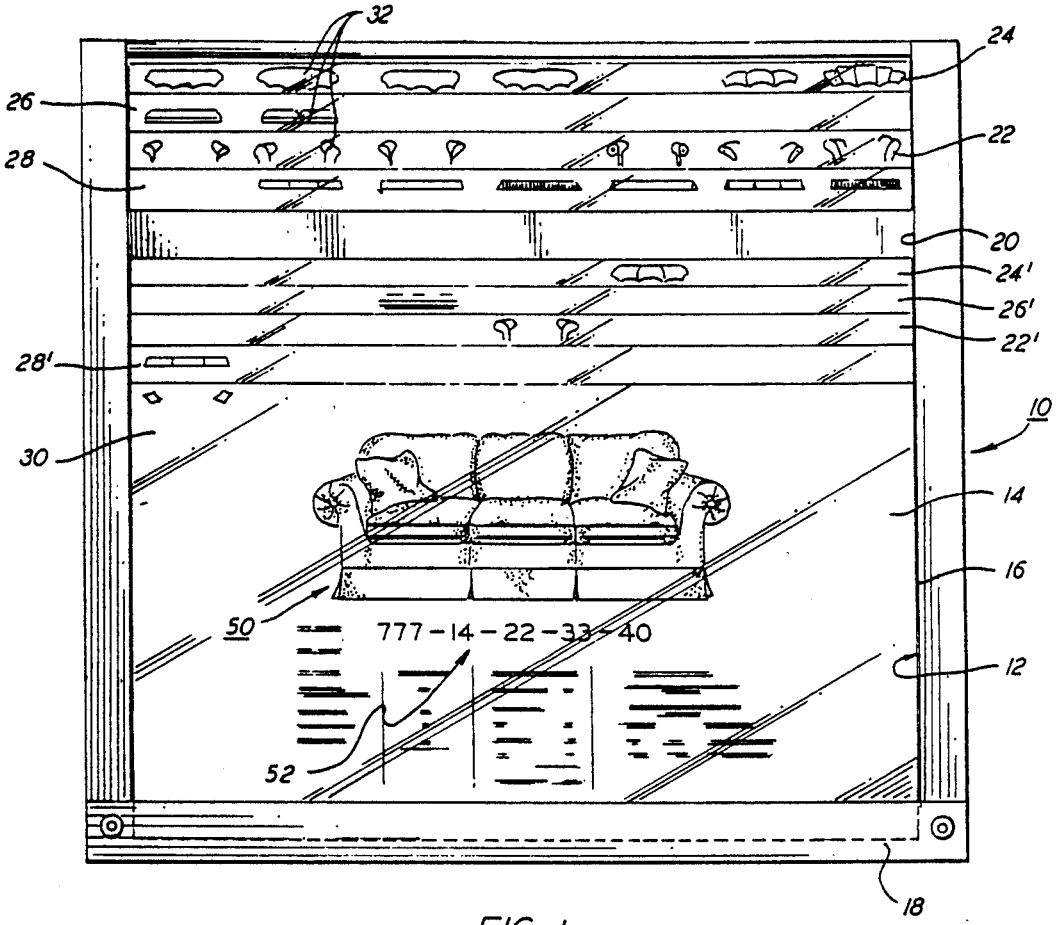
FIG. 1 is a front elevation of an assembled series of transparencies in a display form configuration.

Referring now to FIG. 1 there is shown in front elevation a combination display and storage case 10 according to the present invention. As may be seen in FIG. 3, case 10 includes a front display compartment 12 adapted to receive drawing plate transparencies 14 in overlapping configuration and a storage compartment 20 therefor. The sides 16 and bottom 18 of display compartment 12 are positioned to align the transparencies 14 in registration so that the various elements present a coherent visual image. The furniture element transparencies include arms, cushions, seat backs, skirts and so forth, which when superimposed one upon the other in the display compartment 12 of the case 10 present a pleasing composite picture. There is provided directly behind the display compartment 12 a storage compartment 20 for conveniently storing all of the various furniture element transparencies available for that particular piece of furniture.

As shown in the embodiment of FIG. 1, five sets of furniture element transparencies 22–30 are provided for designing a sofa including arms (22), seat backs (24), seat cushions (26), skirts (28) and pillow (30) arrangements. The five sets of transparencies are stored in the storage compartment 20. Each set has a different vertical dimension. When placed in the storage rack the upper margin of each set can be clearly seen. Displayed in this upper margin are miniature representations 32 of each variety of element. As shown in this embodiment, for instance, there are seven different styles of arms in set 22 that can be chosen, seven different types of skirt arrangements 28, seven different types of back arrangements 24 and so forth that can be selected in various combinations to create the desired artistic effect for a sofa.

Figure 2:
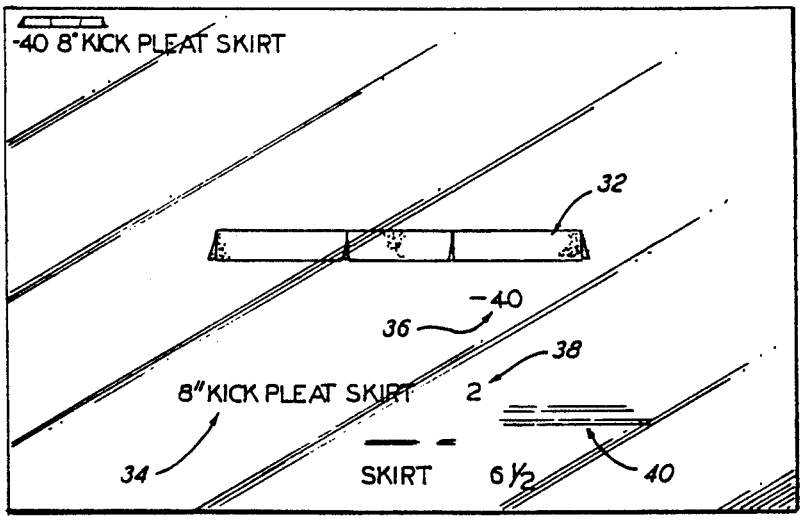
FIG. 2 is a plan view of one transparency.

As may be seen in FIG. 2, each furniture element transparency in a set in addition to a skirt 32 for instance displayed in the proper relative position on the transparency, also carries a title 34, a code number 36, the yardage 38 required for the various portions of the sofa and special notes or features 40 pertinent to the particular element chosen.

In use a transparency from each of the groups of elements of the furniture under consideration is chosen and placed in the display section 12 of the case 10. If one transparency from each set is chosen a complete sofa 50 is displayed for the designer to view. In addition the code numbers, lengths, styles, quantities of material and so forth of each transparency combine to display the complete product description for the sofa as designed. As mentioned above, the complete set of features selected by the customer may be placed in a photocopier to obtain a permanent record of the customer's order.

As may be seen in FIG. 1 a style number 52 which is an eleven digit designation is clearly shown together with the dimensions of the sofa as designed and also the yardage requirements for the various portions of the sofa, all so that the customer/designer can review them right on the display. If it turns out that for some reason one of these elements is not satisfactory, that particular transparency may be removed and another transparency substituted. This will automatically change the yardage requirements, the style number, and the other pertinent information. When assembled with other transparencies from each of the other five groups, the composite pictorial representation of the piece of furniture is displayed together with all the necessary information for ordering that piece of furniture.

While the various elements of the sofa are shown in the storage compartment in ascending vertical size from arm pillows through skirts, arms, cushions, seat backs, they do not have to be displayed in the display section in that sequence. The customer may choose different types of furniture elements until they have designed the furniture the way they want it and they can replace at random individual transparencies until the desired design effect is achieved.

The front display compartment aligns the transparencies so that a pleasing artistic representation of the piece of furniture is displayed and the customer can determine visually whether or not the desired effect has been obtained. The foregoing description has been that of a sofa, but it should be obvious to one skilled in the art that the particular piece of furniture could be an occasional chair, table, dresser or other type of furniture, for which it is desired to offer the customer a design capability.

Figure 3:
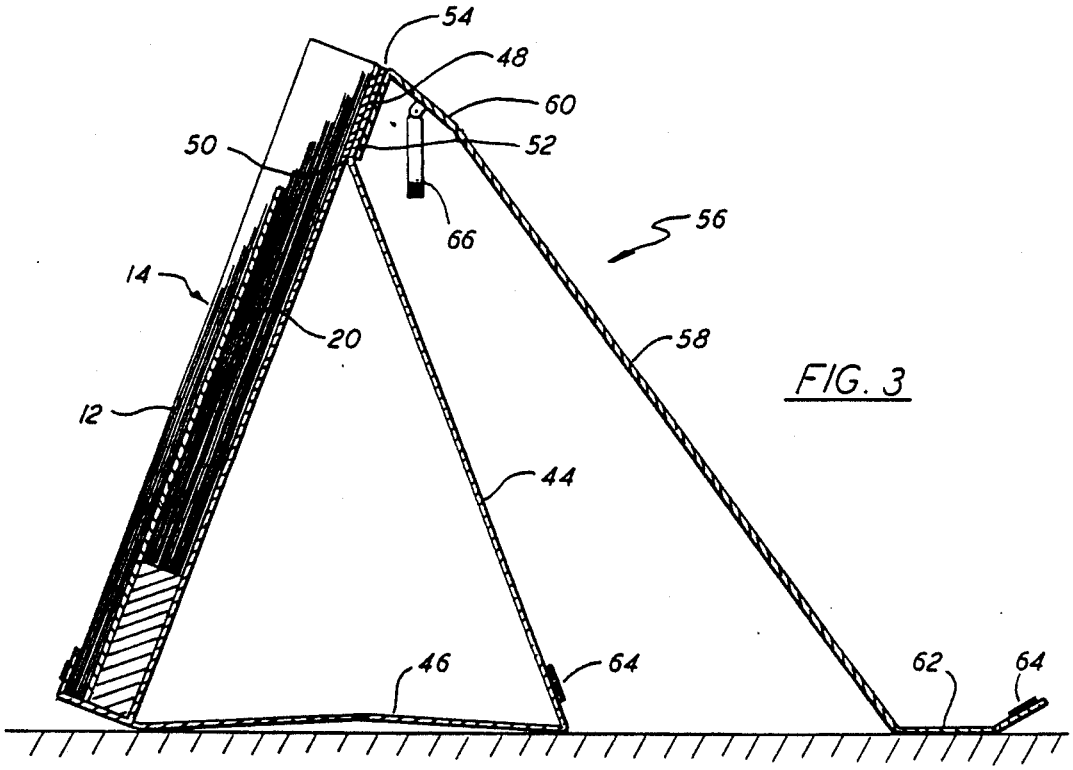
FIG. 3 is a side elevation of the easel of the present invention.
Figure 4:
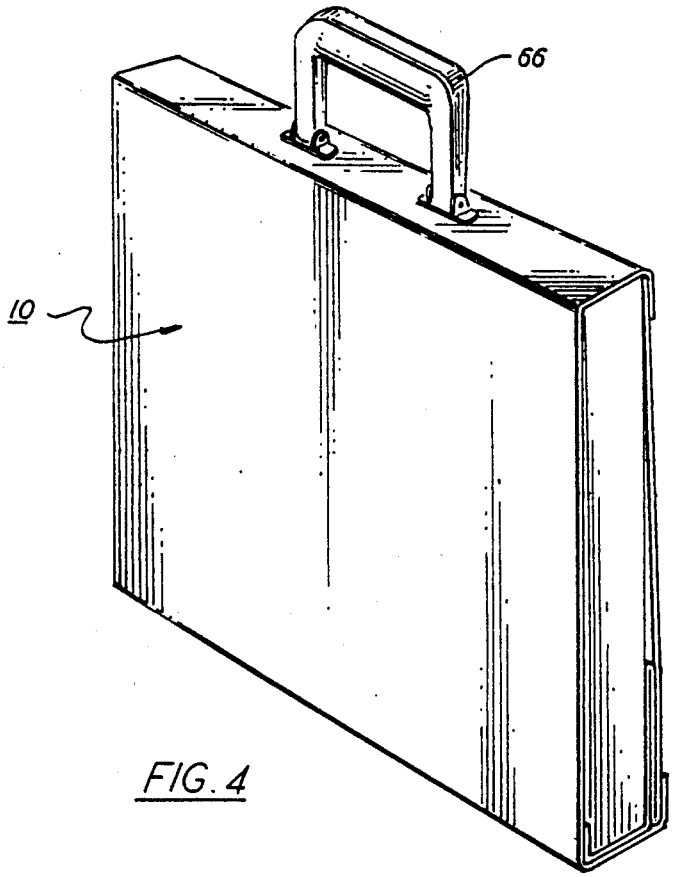
FIG. 4 is a perspective view of the easel in carrying case configuration.

Referring now to FIG. 3, the case 10 opens to a very stable easel arrangement that will stand on any table or other flat surface and not fall over or dump the transparencies either from the display rack or the storage pocket. The easel consists of the adjacent display and storage compartments 12 and 20 which have pivotally secured thereto at the top an easel back member 44 and at the bottom an accordion stay member 46 to hold the back 44 in spaced supporting relationship to the storage and display compartments. The easel back is joined to the upper back edge of the compartment 20 by gluing or other suitable fastening along strip 48 and is hinged at 50 by a bendable fabric which can also be used to decoratively cover the outer surfaces of the display and storage compartments. Also secured at the top of the storage compartment by strip 52 and hinged at 54 by the outer covering is case cover 56 for the storage and display compartments. Cover 56 has a front portion 58, a top section 60 and a bottom closure 62 that wraps around the bottom and secures to the back member 44 when in folded position by suitable closures 64 such as Velcro ™ fasteners or other fastening means to hold the cover 58 about case 10 in the closed configuration. A carrying handle 66 is conveniently affixed to the top section 60 of the cover 56 so that the entire furniture designing display and storage device can be easily carried about as shown in FIG. 4.

It has been found that by allowing the customer to vary the major elements of the furniture, they can get a visual impression of exactly what their furniture might look like and can better decide whether or not it fits with their decor.

In use the designing/display/storage device is taken to the customer's home or other sales location. The customer by picking and choosing various furniture elements can design a custom piece of furniture to fit their individual aesthetic.

While the invention has been described in the specification and illustrated in the drawings with reference to a preferred embodiment, it will be understood by those skilled in the art that various changes may be made and equivalents substituted for elements shown therein without departing from the scope of the invention.

What is claimed is:

1. In a variable graphic display for selectively presenting a combination of design features of an object in a composite pictorial representation, a combination random access storage/display easel and carrying case adapted for storing a plurality of sets of design feature transparencies of an object and displaying one of each set in an overlapping pictorial presentation including:

a first display compartment adapted to receive one transparency from each set of design feature transparencies;

guide means disposed about said first display compartment to operatively engage at least two edges of transparencies placed therein to hold them in overlapping alignment;

a second storage compartment open at the top and having a front and back member, juxtaposed directly behind said first display compartment and adapted to receive therein a plurality of sets of transparencies;

said second storage compartment forming the back of the storage/display easel;

a plurality of sets of object element transparencies disposed in said second compartment each set including a variety of designs for a particular object element; and a composite display of one transparency of each of said sets disposed in overlapping alignment in said first compartment to form a pictorial representation of the object whereby individual custom designs of the object can be created by selectively choosing different individual transparencies from each set of transparencies in said second compartment and superimposing them in overlapping alignment in said first compartment.

2. A device as described in claim 1 wherein each transparency of a set of transparencies has a centrally located large scale representation of a feature to be displayed positioned to cooperatively align with other features represented on a transparency of other sets of transparencies to pictorially present a total object when placed in said first compartment.

3. A device as described in claim 1 wherein each set of object element transparencies has a different vertical dimension.

4. A device as described in claim 3 wherein each transparency of a set of transparencies has in its upper margin a miniature representation of the object located in spaced relationship to the other miniature representations of the set so as not to overlap and obliterate each other when placed in the storage compartment.

5. A device as described in claim 1 wherein said object element transparencies comprise a plurality of furniture element transparencies each displaying thereon a different large scale representation of a furniture element, a code number, element description, material required, special trim required, and dimensions of the article when combined in the manner selected.

6. A device as described in claim 5 wherein said plurality of sets of furniture element transparencies include at least sets of arms, backs, seats and skirts.

7. A device as described in claim 1 further defined by a front cover hingedly secured to the back member of said second compartment and adapted to fold over and protect the first and second compartments, fastening means for securing said front cover to said second compartment; and handle means mounted on said front cover member so that a carrying case is formed for said display compartment.

8. A device as described in claim 1 wherein said second storage compartment has a second back member, hingedly secured to the first back member of said storage compartment and having connected between the bottom of the first back member and the second back member a stay member to selectively hold the first and second backs in spaced relation to form a display easel for the first and second compartments.

9. A device as described in claim 1 further defined by a second back member secured to the back member of said second compartment by a hinge strip, a stay member hingedly connected between the bottom of said second compartment and the bottom edge of said second back member, a front cover hingedly secured to the back of said second back member and adapted to fold over and protect the first and second compartments, fastening means for selectively securing said front cover to the back of said second back member and handle means mounted on said front cover member so that a carrying case is formed for said display compartment.

* * * * *